US007256555B2

(12) United States Patent
Jin et al.

(10) Patent No.: US 7,256,555 B2
(45) Date of Patent: Aug. 14, 2007

(54) BACKLIGHT DRIVING METHOD

(75) Inventors: Hyun-Suk Jin, Gunpo-Si (KR); In-Jue Kim, Ansan-Si (KR); Deuk-Su Lee, Yongin-Si (KR)

(73) Assignee: LG. Philips LCD Co., Ltd., Seoul (KR)

( * ) Notice: Subject to any disclaimer, the term of this patent is extended or adjusted under 35 U.S.C. 154(b) by 37 days.

(21) Appl. No.: 11/168,370

(22) Filed: Jun. 29, 2005

(65) Prior Publication Data

US 2006/0139298 A1 Jun. 29, 2006

(30) Foreign Application Priority Data

Dec. 28, 2004 (KR) ..... 10-2004-0113686

(51) Int. Cl.
*H05B 37/02* (2006.01)

(52) U.S. Cl. ..... 315/291; 315/360

(58) Field of Classification Search ..... 315/161, 315/291, 299, 307, 312, 324, 360; 345/87, 345/102

See application file for complete search history.

(56) References Cited

U.S. PATENT DOCUMENTS 6,636,190 B2 * 10/2003 Hirakata et al. ..... 345/74.1
2004/0051692 A1 * 3/2004 Hirakata et al. ..... 345/102
2006/0125767 A1 * 6/2006 Kang et al. ..... 345/102

* cited by examiner

*Primary Examiner*—Thuy Vinh Tran
(74) *Attorney, Agent, or Firm*—Birch, Stewart, Kolasch & Birch, LLP

(57) ABSTRACT

A method of driving a backlight unit is provided. The backlight includes a plurality of lamps sequentially turned on/off. Each of the plurality of lamps is periodically turned on for a predetermined period. The method includes applying a first lamp current to one of the plurality of lamps for a first time period within the predetermined period so that the one of the plurality of lamps emits light with a first brightness, and applying a second lamp current to the one of the plurality of lamps for a second time period within the predetermined period so that the one of the plurality of lamps emits light with a second brightness.

18 Claims, 7 Drawing Sheets

BACKLIGHT DRIVING METHOD

This Nonprovisional application claims priority under 35 U.S.C. §119(a) on Patent Application No. 10-2004-0113686 filed in Korea on Dec. 28, 2004, the entire contents of which are hereby incorporated by reference

BACKGROUND OF THE INVENTION

1. Field of the Invention

The present invention relates to a backlight unit, and more particularly, to a method of driving a backlight unit and a method of driving a backlight unit of a liquid crystal display (LCD) device.

2. Description of the Related Art

Presently, LCD devices are being developed as the display devices of next generation because of their light weight, thin profile, and low power consumption, and are adopted in a notebook computer, office automation (OA) equipments, audio/video equipments and the like.

In general, an LCD device is a non-emissive display device that displays images using a refractive index difference and optical anisotropy properties of a liquid crystal material interposed between two substrates.

Among the various type of LCD devices commonly used, active matrix LCD (AM-LCD) devices have been developed because of their high resolution and superiority in displaying moving images. The AM-LCD device includes a thin film transistor (TFT) in each pixel region as a switching device, a pixel electrode in each pixel region, and a common electrode.

FIG. 1 is a block diagram of an LCD device according to the related art. FIG. 2 is a schematic view of an LCD panel according to the related art. In FIG. 1, an LCD includes an LCD panel 2 and a driving circuit unit (not shown) connected to the LCD panel 2, wherein the driving circuit unit is disposed in a periphery of the LCD panel 2. A data signal for red, green and blue colors and a control signal such as an input clock, a horizontal synchronizing signal, a vertical synchronizing signal, a data enable signal and the like is generated from a driving system such as a personal computer to the drive circuit unit. An interface 10 transmits the mentioned data signal and the control signal to a timing controller 12. For example, a low voltage differential signal (LVDS) interface and a telescope technologies limited (TTL) interface are utilized as a typical interface. In the alternative, the timing controller 12 may be formed as a single chip including function of the interface 10.

In FIGS. 1 and 2, the LCD panel 2 includes a plurality of gate lines GL1 to GLn (n is a positive integral) and a plurality of data lines DL1 to DLm (m is a positive integral) crossing the gate lines GL1 to GLn to define a plurality of pixel regions (not shown).

The timing controller 12 generates a control signal for driving a gate driver 20 connected to the gate lines GL1 to GLn and a data driver 18 connected to the data lines DL1 to DLm, wherein the gate driver 20 includes a plurality of gate integrated circuits using the control signal. In addition, the data and control signal is applied to an interface 10, and the interface 10 transmits the data and control signal to the data driver 18.

A reference voltage generator 16 generates a reference voltage of a Digital to Analog Converter (DAC) utilized in the data driver 18, wherein the reference voltage generator 16 is predetermined by a manufacturer with respect to transmittance versus voltage of an LCD panel 2. The data driver 18 responses to the control signals from the timing controller 12 and selects the reference voltage for converting as analog video data. Furthermore, an analog video data generated by the selected reference voltage is supplied to the LCD panel 2, thereby controlling a rotation angle of the liquid crystal molecules.

The gate driver 20 responses to the control signals from the timing controller 12, thereby controlling ON/OFF of a plurality of thin film transistors TFT formed in the LCD panel 2. Here, the gate lines GL1 to GLn are sequentially enabled by the horizontal synchronizing signal and the thin film transistors TFT are sequentially driven by the gate lines GL1 to GLn. Then a plurality of analog image signals from the data driver 18 are applied to the pixels connected to the thin film transistors TFT, wherein each of the pixels corresponds to one of the thin film transistors TFT. In addition, a power supply voltage generator 14 provides a power to respective elements and a common voltage to the LCD panel 2.

Although not shown, a backlight unit, light source, is disposed under the LCD panel 2. Particularly, a direct type backlight unit having a plurality of lamps is utilized when the LCD panel is a large size panel. The direct type backlight unit does not include a light guide plate that changes line light into plane light, but includes the lamps, a reflective sheet preventing light loss where light emitted from lamp is reflected to an image display surface, and light scattering means including a diffusion plate and a plurality of diffusion sheets that emit a uniform light by scattering light toward a top portion of the lamps.

FIG. 3 is a schematic perspective view showing a direct type backlight unit for an LCD device according to the related art. In FIG. 3, a backlight unit includes a plurality of lamps 1, a bottom case 3 fixing and supporting the plurality of lamps 1, and light scattering means 5*a*, 5*b* and 5*c* arranged between the lamps 1 and the LCD panel (not shown), wherein the light scattering means 5*a*, 5*b* and 5*c* provide a light source having a uniform luminosity distribution and prevent image defect, wherein the light scattering means 5*a*, 5*b* and 5*c* may further include a plurality of diffusion sheets and a diffusion plate to increase a light scattering effect.

A reflector 7 is arranged on an inner surface of the bottom case 3 in order to effectively provide light from the lamp 1 to the LCD panel. The lamp 1 includes a cold fluorescent lamp (CCFL), wherein the lamp 1 includes a glass tube, electrodes (not shown) disposed on both end portions of the glass tube. The lamp 1 emits light when power is applied to the electrodes and both end portions of the lamp 1 are fixed in a groove formed in both sides of the bottom case 3.

FIG. 4 is a schematic cross-sectional view of a direct type backlight unit for an LCD device of FIG. 3 according to the related art. In FIG. 4, a direct type backlight unit includes a plurality of lamps 1 parallel with each other along the same direction, a bottom case 3 supporting the lamps 1, a diffusion plate 5*a* connected to the bottom case 3, and a plurality of optical sheets 5*b* and 5*c* over the diffusion plate 5*a*. More specifically, an end portion of the diffusion plate 5*a* contacts the bottom case 3. The direct type backlight unit is driven by a scanning driving method such that the respective lamps 1 is sequentially turned ON/OFF in accordance with a frame driving of the LCD panel in order to reduce a power consumption.

FIG. 5 is a timing chart illustrating a driving method of a direct type backlight unit with respect to one lamp according to the related art. In FIG. 5, a timing chart shows that respective lamps is sequentially turned ON/OFF in accordance with a scanning ON/OFF period of a thin film transistor of a gate driver, wherein ON/OFF is performed during one frame period of the LCD panel. In other words, the scanning driving type backlight unit sequentially emits light by supplying concentrated light with respect to only a predetermined region of the LCD panel. For example, when the LCD panel with Extended Graphics Array (XGA; 1024×768) resolution includes eight lamps L1-L8, one of the eight lamps L1 to L8 may control about one hundred of pixel lines.

FIG. 6 is a timing chart illustrating a driving method of one lamp for a direct type backlight unit with respect to one lamp according to the related art. In FIG. 6, since each one of the eight lamps L1 to L8 (of FIG. 5) controls about one hundred of pixel lines in the XGA type LCD panel, the lamp brightness LB in a top position TP, a center position CP and a bottom position BP with respect to the one hundred of pixel lines is the same as each other. However, the faster the liquid crystal response TL driven by synchronizing with a gate signal of the gate driver that goes down from the top position TP to the bottom position BP, the less the driving time in accordance with scanning driving of the gate line is delayed.

Further, since the direct type backlight unit is repeatedly turned ON/OFF, the panel brightness is lower than another driving type such that the lamp is always in ON state. To overcome this problem, a method of driving is suggested such that the lamp brightness increases by increasing a lamp current applied to the lamp.

FIG. 7 is a timing chart illustrating a driving method of a direct type backlight unit with respect to one lamp according to the related art. In FIG. 7, a higher lamp current is applied to the lamp to increase brightness, thereby increasing the panel brightness. However, when the lamp is driven by applying a high lamp current, the high lamp current is applied before the liquid crystal layer has completely responded, as shown in region A, thereby accruing unnecessary power consumption. In addition, when high brightness is obtained after response of the liquid crystal layer is reduced, as shown in region B, the blur reduction resulting from the scanning type backlight unit is depressed.

SUMMARY OF THE INVENTION

Accordingly, the present invention is directed to a method of driving a backlight unit and a method of driving a backlight unit of a liquid crystal display device that substantially obviate one or more of the problems due to limitations and disadvantages of the related art.

An object of the present invention is to provide a method of driving a backlight unit that can improve brightness by reducing lamp driving power consumption.

Another object of the present invention is to provide a method of driving a backlight unit that can maintain an effect of blur reduction resulting from a scanning driving method.

Another object of the present invention is to provide a method of driving a backlight unit of a liquid crystal display device that can improve brightness by reducing lamp driving power consumption.

Another object of the present invention is to provide a method of driving a backlight unit of a liquid crystal display device that can maintain an effect of blur reduction resulting from a scanning driving method.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a backlight unit, the backlight including a plurality of lamps sequentially turned on/off, each of the plurality of lamps being periodically turned on for a predetermined period, the method includes: applying a first lamp current to one of the plurality of lamps for a first time period within the predetermined period so that the one of the plurality of lamps emits light with a first brightness; and applying a second lamp current to the one of the plurality of lamps for a second time period within the predetermined period so that the one of the plurality of lamps emits light with a second brightness.

In another aspect, a method of driving a backlight unit of a liquid crystal display device, the liquid crystal display device including a backlight unit, first and second substrates facing each other, and a liquid crystal layer between the first and second substrates, the backlight unit including a plurality of lamps sequentially turned on/off, each of the plurality of lamps being periodically turned on for a predetermined period, the method includes: applying a first lamp current to one of the plurality of lamps for a first time period within the predetermined period so that the one of the plurality of lamps emits light with a first brightness; and applying a second lamp current to the one of the plurality of lamps for a second time period within the predetermined period so that the one of the plurality of lamps emits light with a second brightness.

In another aspect, a method of driving a backlight unit of a liquid crystal display device, the backlight unit having a plurality of lamps, each of the plurality of lamps being periodically turned on for a predetermined period, the method includes: increasing a current applied to one of the plurality of lamps from a first level to a second level for a time period within the predetermined period upon completion of a response of a liquid crystal layer of the liquid crystal display device.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or the like parts.

A backlight unit according to an embodiment of the present invention includes a plurality of lamps sequentially turned ON/OFF, wherein the lamps are disposed in parallel with each other. For example, the lamps are driven by a lamp current provided by an inverter connected to the backlight unit. In addition, each of the lamps is periodically turned on for a predetermined period PT.

A method of driving the backlight unit as illustrated in this embodiment includes applying a first lamp current to one of the plurality of lamps for a first time period within a predetermined period so that the one of the plurality of lamps can emit light with a first brightness, and applying a second lamp current to the same lamp for a second time period within the predetermined period so that the same lamp can emit light with a second brightness, wherein the second brightness is higher than the first brightness.

Figure 1:
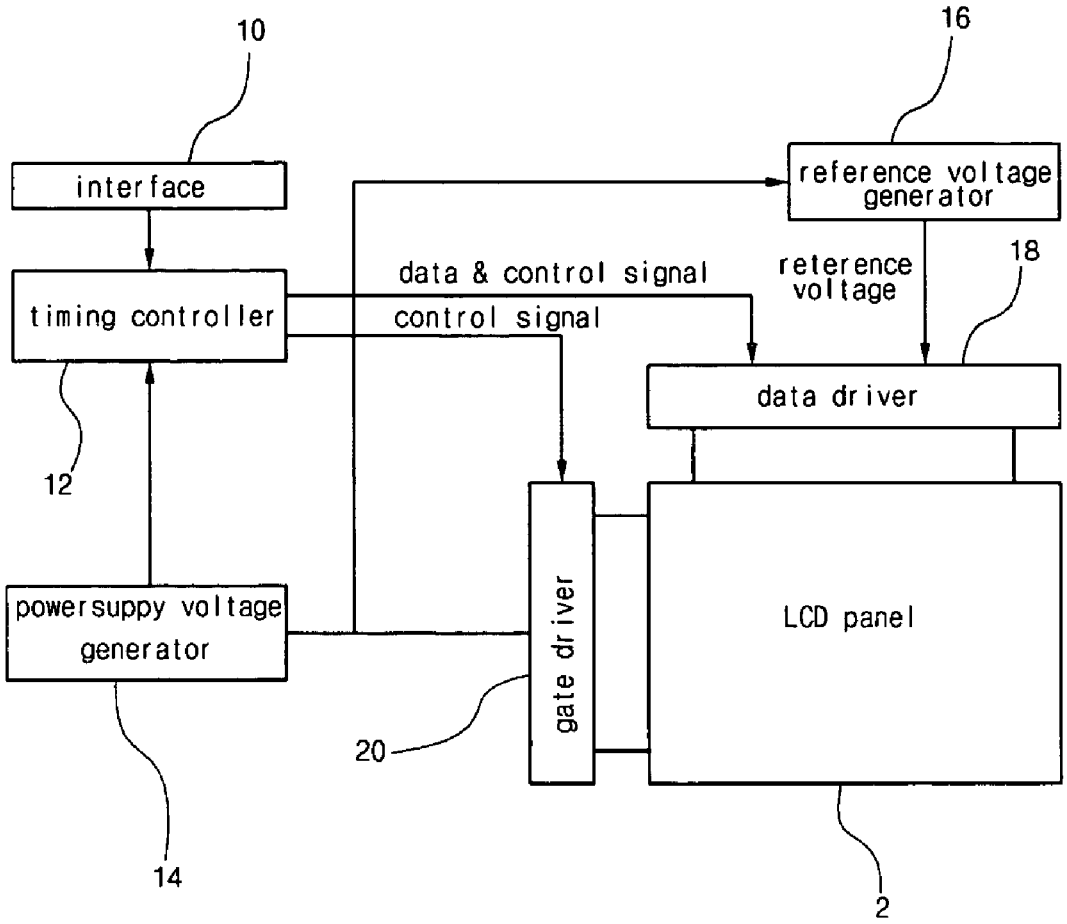
FIG. 1 (related art)
FIG. 1 is a block diagram of an LCD device according to the related art.
Figure 2:
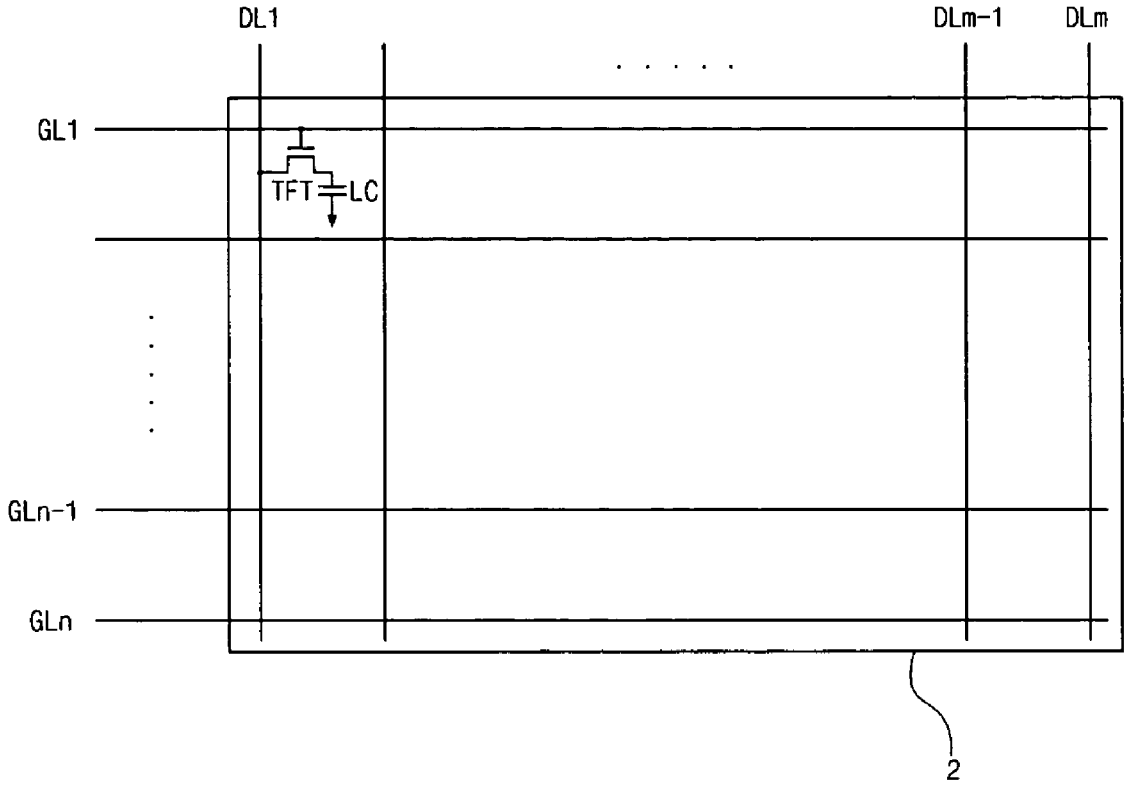
FIG. 2 (related art)
FIG. 2 is a schematic view of an LCD panel according to the related art.
Figure 3:
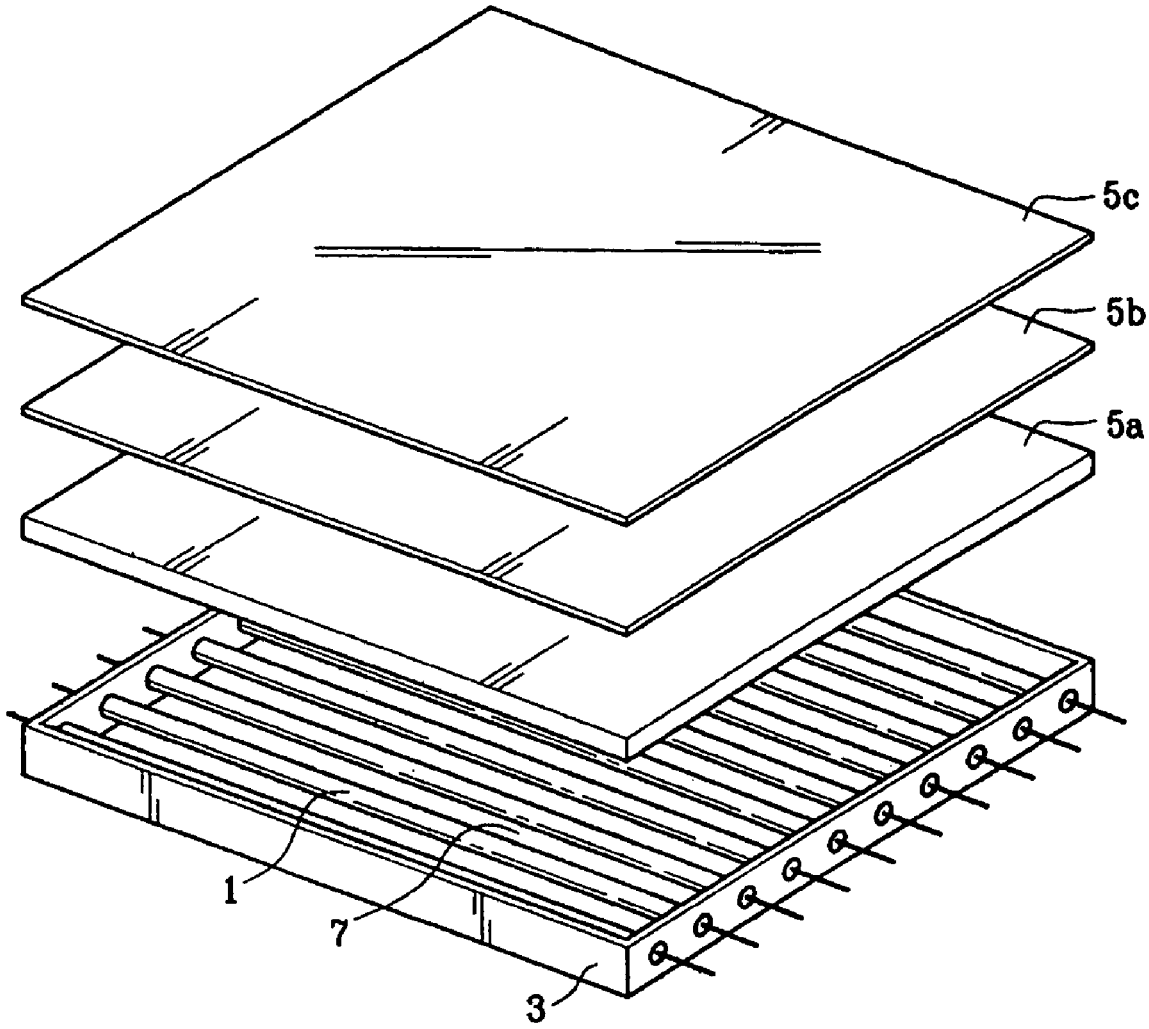
FIG. 3 (related art)
FIG. 3 is a schematic perspective view showing a direct type backlight unit for an LCD device according to the related art.
Figure 4:
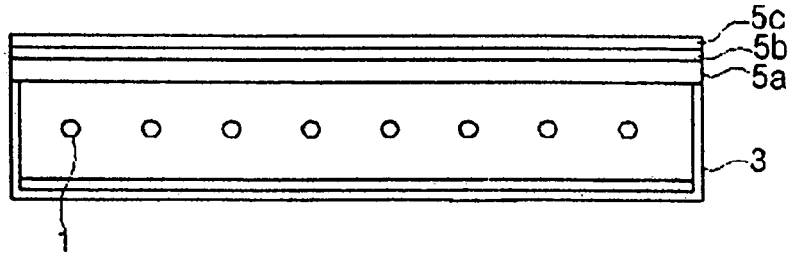
FIG. 4 (related art)
FIG. 4 is a schematic cross-sectional view of a direct type backlight unit for an LCD device of FIG. 3 according to the related art.
Figure 5:
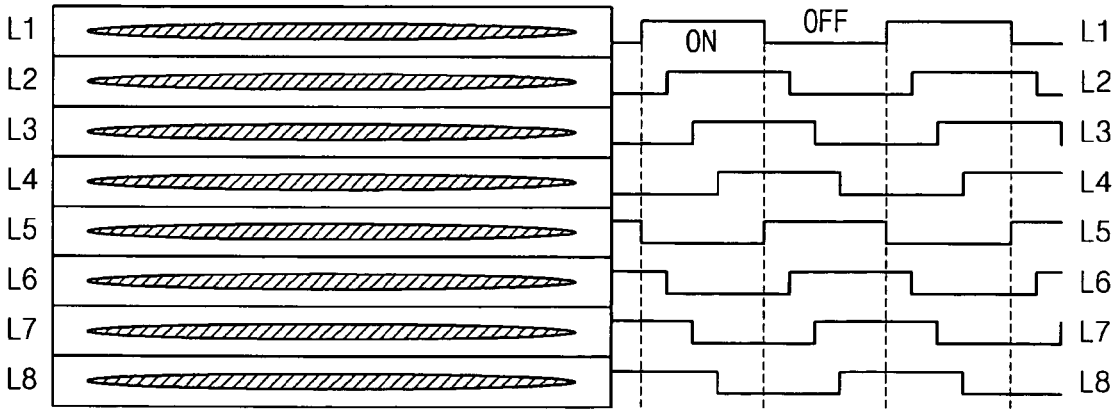
FIG. 5 (related art)
FIG. 5 is a timing chart illustrating a driving method of a direct type backlight unit according to the related art.
Figure 6:
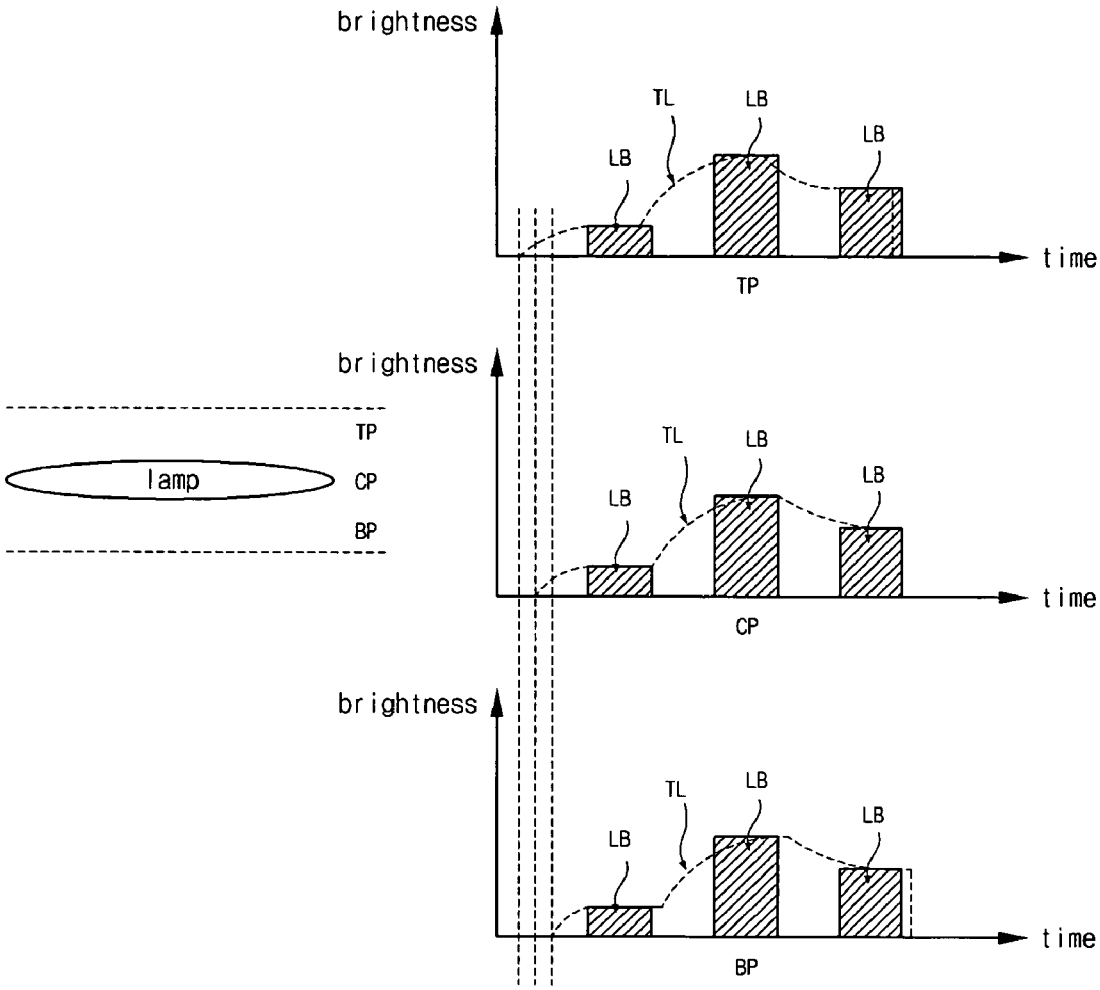
FIG. 6 (related art)
FIG. 6 is a timing chart illustrating a driving method of a direct type backlight unit with respect to one lamp according to the related art.
Figure 7:
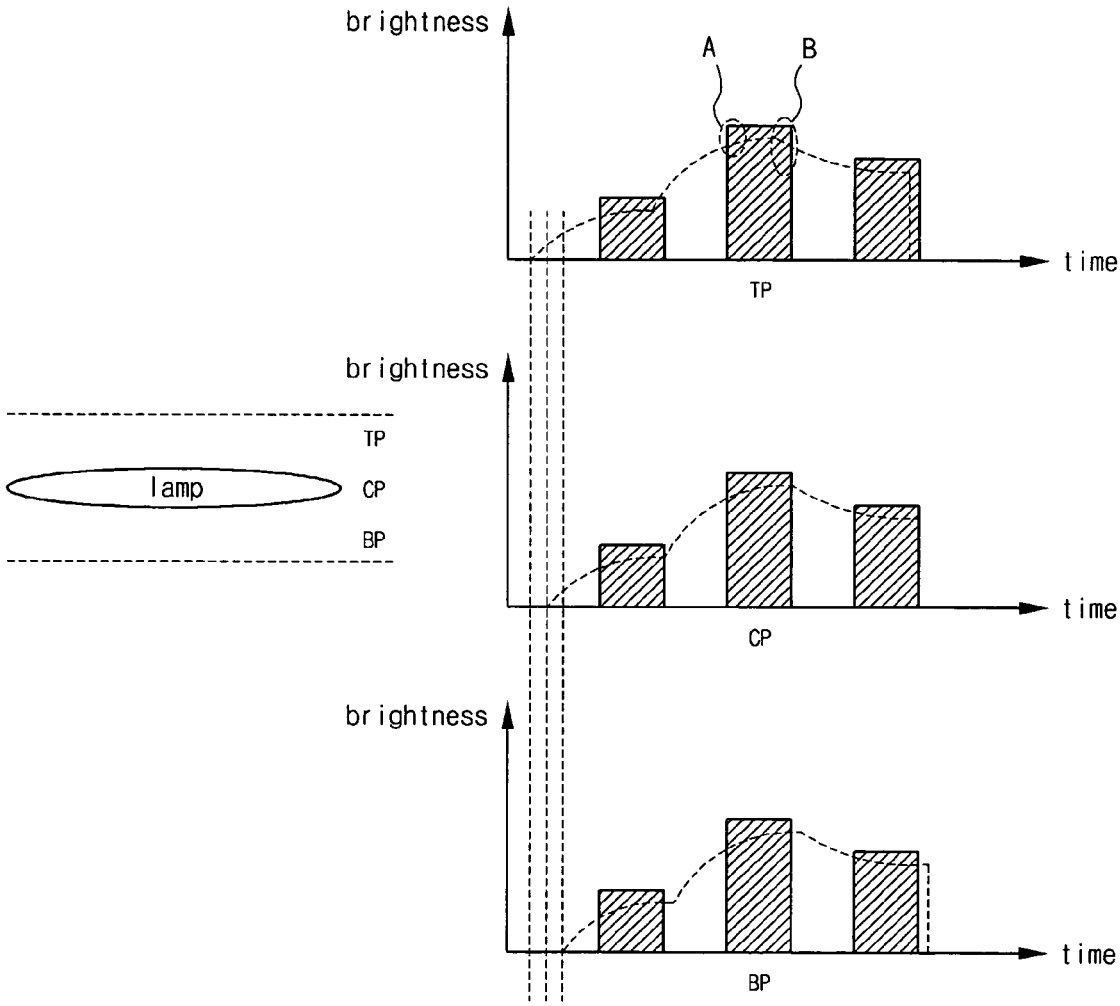
FIG. 7 (related art)
FIG. 7 is a timing chart illustrating a driving method of a direct type backlight unit with respect to one lamp according to the related art.
Figure 8:
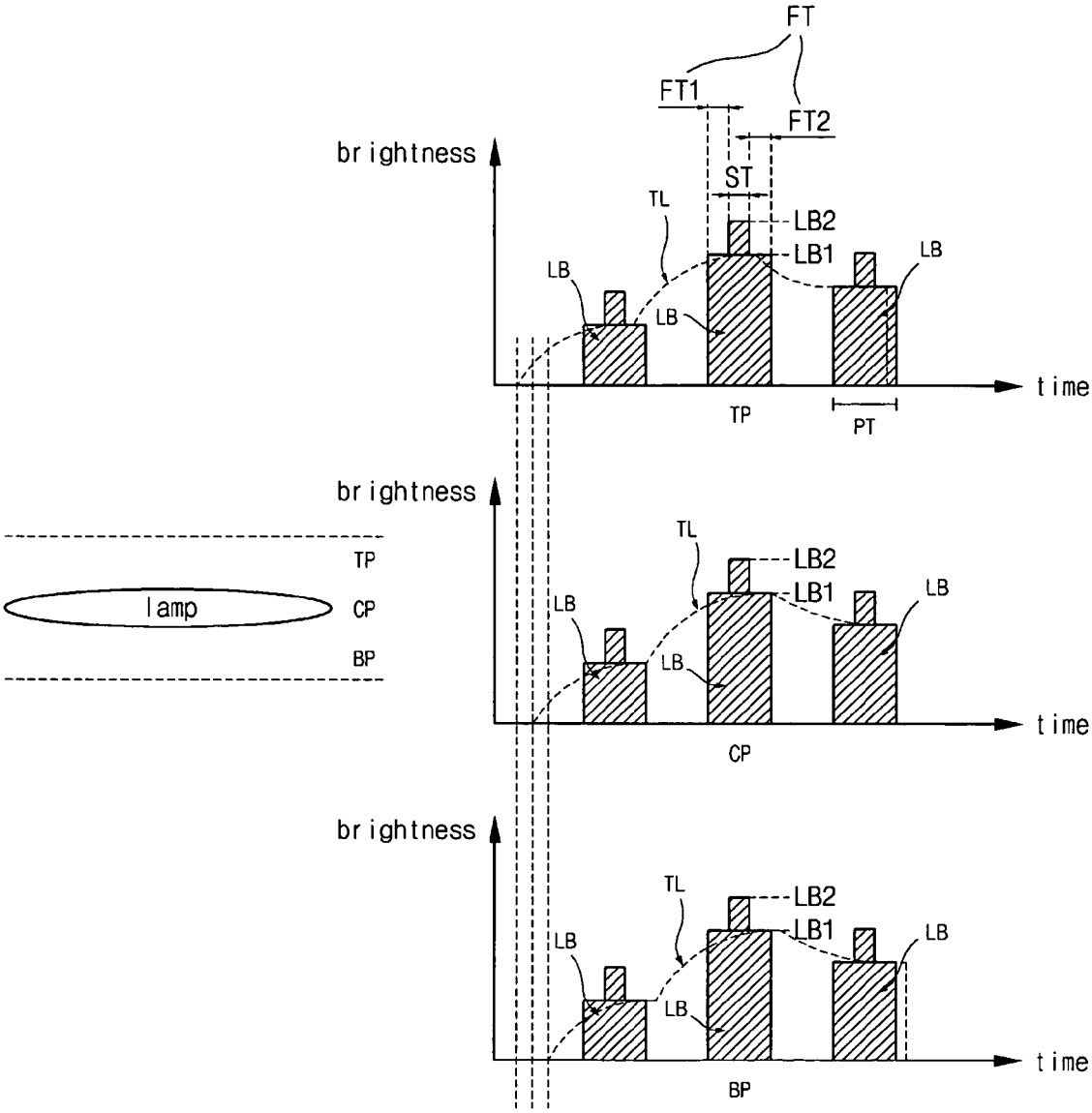
FIG. 8 is a schematic timing chart illustrating a driving method of a direct type backlight unit with respect to one lamp according to an embodiment of the present invention.

FIG. 8 is a schematic timing chart illustrating a driving method of a direct type backlight unit with respect to one lamp according to an embodiment of the present invention. In FIG. 8, the first through third timing charts show the relationship between lamp brightness LB and timing of a liquid crystal response TL in a top position TP, a center position CP and a bottom position BP with respect to a plurality of pixels controlled by one lamp.

The backlight unit includes a direct type that the lamps are disposed under a LCD panel, wherein the lamps are parallel with each other. The direct type backlight unit is driven by a scanning type method and by using an inverter (not shown) connected to the direct type backlight unit, wherein the inverter provides a first lamp current that is applied to one of the amps. At this time, the lamp brightness LB is maintained until the LCD panel has a first brightness LB1.

Next, when the response of the liquid crystal layer is completed or right after the response of the liquid crystal layer is completed when the first lamp current is applied to the lamp, a second lamp current higher than the first lamp current is applied to the same lamp until the LCD panel has a second brightness LB2 greater than the first brightness LB1. Likewise, the second lamp current is supplied from the inverter. For example, the first lamp current is less than about 6 milli-amperes (mA) and the second lamp current is more than about 6 milli-amperes (mA).

As shown in FIG. 8, the first and second lamp currents are applied for the first and second time periods FT and ST, respectively. In this embodiment, the second time period ST is shorter than the first time period FT and the second time period ST is within the predetermined period PT. In addition, in this embodiment, the first time period FT includes a first time segment FT1 and a second time segment FT2, and the second time period ST occurs between the first time segment FT1 and the second time segment FT2. As shown in FIG. 8, after applying the second, higher, lamp current for the second time period ST, the lamp current is reduced back to the first lamp current. Meanwhile, the lamps include a first lamp and a second lamp adjacent to the first lamp, and the predetermined period PT of the first lamp overlaps with the predetermined period PT of the second lamp.

Although not shown, a liquid crystal display device includes a backlight unit, first and second substrates facing each other, and a liquid crystal layer between the first and second substrates. The backlight unit includes a plurality of lamps sequentially turned ON/OFF. In addition, each of the lamps is periodically turned on for a predetermined period PT. To drive the backlight unit of the liquid crystal display device, the method as illustrated in this embodiment includes applying a first lamp current to one of the lamps for a first time period within the predetermined period so that the one of the lamps emits light with a first brightness, and applying a second lamp current to the same lamp for a second time period within the predetermined period so that the lamp emits light with a second brightness. In this embodiment, the second lamp current is greater than the first lamp current; the second brightness is higher than the first brightness; the first and second lamp currents are applied for first and second time periods, respectively; and the second time period is shorter than the first time period.

Meanwhile, the lamps include a first lamp and a second lamp adjacent to the first lamp. The predetermined period of the first lamp overlaps with the predetermined period of the second lamp, wherein the first lamp current is less than about 6 milli-amperes (mA) and the second lamp current is more than about 6 milli-amperes (mA). Here, the second lamp current is applied when the response of the liquid crystal layer is completed, or right after the response of the liquid crystal layer is completed.

As explained above, the method of driving the backlight unit as illustrated in the embodiment provides an advantage that the lamp efficiency of the backlight unit is effectively increased because the second, higher, lamp current is not applied in the entire ON state of the lamp. The second lamp current only lasts for a short time period when the response of the liquid crystal layer is completed or right after the response of the liquid crystal layer is completed. Further, an effect of blur reduction resulting from the scanning driving method is maintained because the higher lamp current or brightness is not supplied at the point the response of the liquid crystal is depressed. Unlike the illustrated embodiment, the related art method merely applies one lamp current in the entire period when the lamp is in ON state, which would either provide lower panel brightness, accrues unnecessary power consumption or depress the blur reduction.

It will be apparent to those skilled in the art that various modifications and variations can be made in the liquid crystal display devices of the present invention without departing from the spirit or scope of the invention. Thus, it is intended that the present invention covers the modifications and variations of this invention provided they come within the scope of the appended claims and their equivalents.

What is claimed is:

1. A method of driving a backlight unit, the backlight unit including a plurality of lamps sequentially turned on/off, each of the plurality of lamps being periodically turned on for a predetermined period, the method comprising:

applying a first lamp current to one of the plurality of lamps for a first time period within the predetermined period so that the one of the plurality of lamps emits light with a first brightness; and applying a second lamp current to the one of the plurality of lamps for a second time period within the predetermined period so that the one of the plurality of lamps emits light with a second brightness, wherein the first time period includes a first time segment and a second time segment, and the first time segment and the second time segment are separated by the second time period.

2. The method according to claim 1, wherein the second lamp current is greater than the first lamp current.

3. The method according to claim 1, wherein the second brightness is higher than the first brightness.

4. The method according to claim 1, wherein the second time period is shorter than the first time period.

5. The method according to claim 4, wherein the plurality of lamps include a first lamp and a second lamp adjacent to the first lamp, the predetermined period of the first lamp overlapping with the predetermined period of the second lamp.

6. The method according to claim 1, wherein the first lamp current is less than about 6 milli-amperes (mA) and the second lamp current is more than about 6 milli-amperes (mA).

7. A method of driving a backlight unit of a liquid crystal display device, the liquid crystal display device including the backlight unit, first and second substrates facing each other, and a liquid crystal layer between the first and second substrates, the backlight unit including a plurality of lamps sequentially turned on/off, each of the plurality of lamps being periodically turned on for a predetermined period, the method comprising:

applying a first lamp current to one of the plurality of lamps for a first time period within the predetermined period so that the one of the plurality of lamps emits light with a first brightness; and applying a second lamp current to the one of the plurality of lamps for a second time period within the predetermined period so that the one of the plurality of lamps emits light with a second brightness, wherein the first time period includes a first time segment and a second time segment, and the first time segment and the second time segment are separated by the second time period.

8. The method according to claim 7, wherein the second lamp current is greater than the first lamp current.

9. The method according to claim 8, wherein the first lamp current is less than about 6 milli-amperes (mA) and the second lamp current is more than about 6 milli-amperes (mA).

10. The method according to claim 7, wherein the second brightness is higher than the first brightness.

11. The method according to claim 7, wherein the second time period is shorter than the first time period.

12. The method according to claim 11, wherein the plurality of lamps include a first lamp and a second lamp adjacent to the first lamp, the predetermined period of the first lamp overlapping with the predetermined period of the second lamp.

13. The method according to claim 7, wherein the step of applying the second current includes applying the second lamp current when response of the liquid crystal layer is completed.

14. The method according to claim 7, wherein the step of applying the second current includes applying the second lamp current right after response of the liquid crystal layer is completed.

15. A method of driving a backlight unit of a liquid crystal display device, the backlight unit having a plurality of lamps, each of the plurality of lamps being periodically turned on for a predetermined period, the method comprising:

applying a current of a first level to one of the plurality of lamps; and increasing the current applied to the one of the plurality of lamps from the first level to a second level for a time period within the predetermined period upon completion of a response of a liquid crystal layer of the liquid crystal display device corresponding to the one of the plurality of lamps.

16. The method according to claim 15, further comprising reducing the current to the first level after the time period ends and until the predetermined period ends.

17. The method according to claim 15, wherein a brightness of the one of the plurality of lamps when the current is in the second level is higher than the brightness of the one of the plurality of lamps when the current is in the first level.

18. The method according to claim 15, wherein the plurality of lamps include a first lamp and a second lamp adjacent to the first lamp, the predetermined period of the first lamp overlapping with the predetermined period of the second lamp.

* * * * *